US011693345B2

(12) United States Patent
Kodera et al.

(10) Patent No.: US 11,693,345 B2
(45) Date of Patent: Jul. 4, 2023

(54) TRANSPORT DEVICE, FIXING DEVICE, AND IMAGE FORMING APPARATUS

(71) Applicant: FUJIFILM Business Innovation Corp., Tokyo (JP)

(72) Inventors: Tetsuro Kodera, Kanagawa (JP); Takayuki Yamashita, Kanagawa (JP); Yoshiki Shimodaira, Kanagawa (JP); Mitsuhiro Matsumoto, Kanagawa (JP); Kosuke Yamada, Kanagawa (JP); Masato Yamashita, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/556,040

(22) Filed: Dec. 20, 2021

(65) Prior Publication Data

US 2023/0060783 A1 Mar. 2, 2023

(30) Foreign Application Priority Data

Aug. 25, 2021 (JP) ..... 2021-137620

(51) Int. Cl.
*G03G 15/20* (2006.01)
*G03G 15/16* (2006.01)

(52) U.S. Cl.
CPC ..... *G03G 15/2053* (2013.01); *G03G 15/167* (2013.01); *G03G 15/2064* (2013.01)

(58) Field of Classification Search
None
See application file for complete search history.

(56) References Cited

U.S. PATENT DOCUMENTS

2006/0056886 A1* 3/2006 Ohishi ..... B41J 13/025 399/328

FOREIGN PATENT DOCUMENTS

JP 61002165 A * 1/1986
JP 2006-259223 A 9/2006

OTHER PUBLICATIONS

Translation of JP-61002165-A (Year: 1986).*

* cited by examiner

*Primary Examiner* — Arlene Heredia
(74) *Attorney, Agent, or Firm* — Oliff PLC

(57) ABSTRACT

A transport device includes a rotating body including a recessed portion on an outer surface, a rotatable heat unit that is in contact with the outer surface of the rotating body and forms an interposition region in which a recording medium is interposed between the heat unit and the rotating body, a transport unit that: (i) includes a hold member capable of holding a portion of the recording medium near a leading edge, (ii) transports the recording medium by moving the hold member in a rotational direction of the rotating body with the hold member contained in the recessed portion, and (iii) causes the hold member to pass through the interposition region, and a controller that controls rotation of the rotating body such that the recessed portion stops at a position upstream or downstream of the interposition region in the rotational direction when an anomaly is detected.

20 Claims, 11 Drawing Sheets

TRANSPORT DEVICE, FIXING DEVICE, AND IMAGE FORMING APPARATUS

CROSS-REFERENCE TO RELATED APPLICATIONS

This application is based on and claims priority under 35 USC 119 from Japanese Patent Application No. 2021-137620 filed Aug. 25, 2021.

BACKGROUND

(i) Technical Field

The present disclosure relates to a transport device, a fixing device, and an image forming apparatus.

(ii) Related Art

Japanese Unexamined Patent Application Publication No. 2006-259223 discloses a fixing device that includes a pair of a first fixing roller and a second fixing roller at least one of which is a heat roller and has a changeable surface layer, an affixation unit that includes an affixation member, a charging unit that charges at least a recording medium or the affixation unit, and a fixation unit that physically fixes an end portion of the recording medium in the direction of transportation to the affixation unit by using a grip portion. The affixation member and the recording medium are electrostatically attracted by the charging unit, and the recording medium is fixed to the affixation unit by using the fixation unit. Subsequently, the recording medium is interposed between the pair of fixing rollers and is transported together with the affixation unit, and consequently, an image is fixed.

SUMMARY

A configuration that is thought for a transport device that has a function of heating a recording medium includes a rotating body that has a recessed portion on an outer surface, a heat unit that forms an interposition region in which the recording medium is interposed between the heat unit and the rotating body, and a transport unit that transports the recording medium by moving a hold member with the hold member holding a portion of the recording medium near a leading edge and with the hold member contained in the recessed portion and that causes the hold member to pass through the interposition region.

In the case where the hold member stops at the interposition region when an anomaly is detected with the configuration, the temperature of the hold member increases due to the heat of the heat unit.

Aspects of non-limiting embodiments of the present disclosure relate to a configuration that includes a hold member that passes through a recording-medium interposition region that is formed by a rotating body and a heat unit with the hold member contained in a recessed portion on an outer surface of the rotating body and the case where the temperature of the hold member is inhibited from increasing due to the heat of the heat unit unlike the case where the recessed portion in which the hold member is contained stops at the interposition region when an anomaly is detected.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a transport device including a rotating body that has a recessed portion on an outer surface, a heat unit that is in contact with the outer surface of the rotating body, that rotates, and that forms an interposition region in which a recording medium is interposed between the heat unit and the rotating body, a transport unit that includes a hold member capable of holding a portion of the recording medium near a leading edge, that transports the recording medium by moving the hold member in a direction of rotation of the rotating body with the hold member contained in the recessed portion, and that causes the hold member to pass through the interposition region, and a controller that controls rotation of the rotating body such that the recessed portion stops at a position upstream or downstream of the interposition region in the direction of rotation of the rotating body when an anomaly is detected.

BRIEF DESCRIPTION OF THE DRAWINGS

Exemplary embodiments of the present disclosure will be described in detail based on the following figures, wherein.

DETAILED DESCRIPTION

A fixing device and an image forming apparatus according to an exemplary embodiment of the present disclosure will be described with reference to FIG. 1 to FIG. 11. An arrow H illustrated in figures represents the vertical direction of the apparatus. An arrow W represents the width direction of the apparatus (a horizontal direction). An arrow D represents the depth direction of the apparatus (a horizontal direction).

Image Forming Apparatus 10

Figure 1:
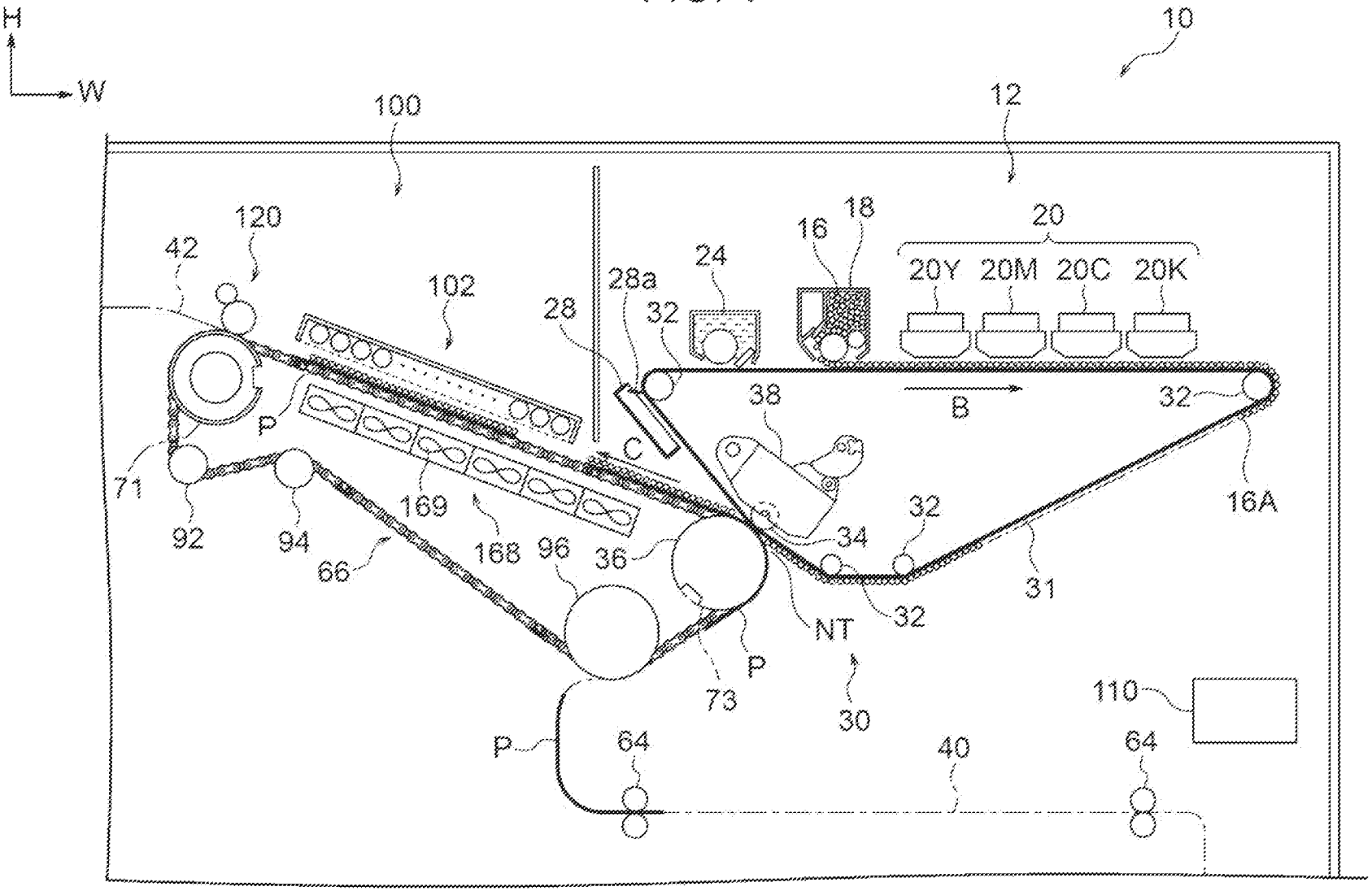
FIG. 1 schematically illustrates a front view of a part of an ink-jet image forming apparatus according to an exemplary embodiment of the present disclosure.
Figure 5:
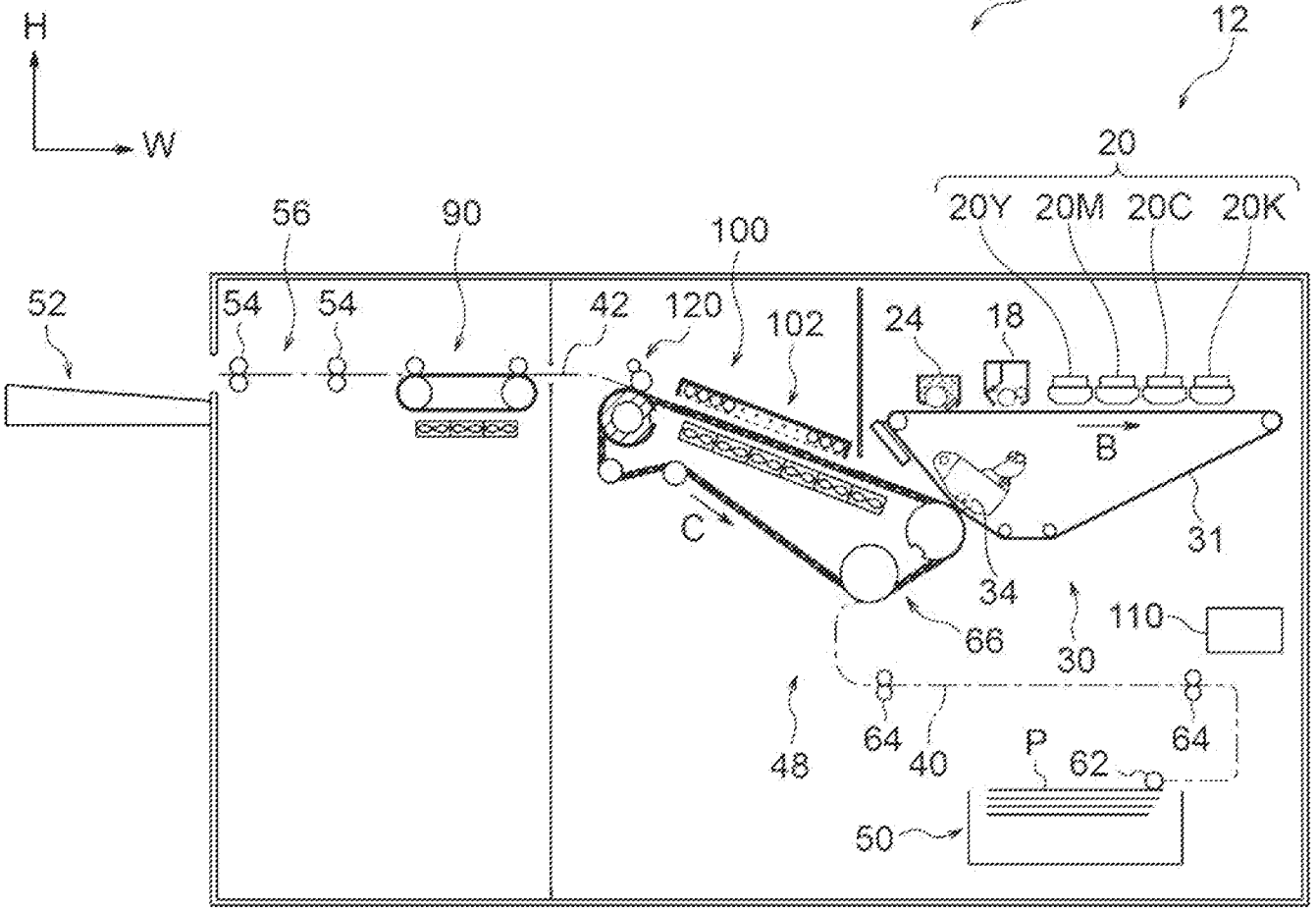
FIG. 5 schematically illustrates a front view of the entire image forming apparatus according to the exemplary embodiment in FIG. 1.

The configuration of an image forming apparatus 10 according to the present exemplary embodiment will be described. FIG. 1 schematically illustrates a part (an image forming unit 12, a transfer portion 30, and a fixing portion 100) of the image forming apparatus 10 according to the present exemplary embodiment. FIG. 5 schematically illustrates the entire image forming apparatus 10 according to the present exemplary embodiment.

The image forming apparatus 10 according to the present exemplary embodiment is an ink-jet image forming apparatus that forms an ink image on a sheet material P, based on image information that is inputted into the apparatus. The sheet material P is an example of a recording medium. The ink image is an example of an image. As illustrated in FIG. 5, the image forming apparatus 10 includes a container unit 50, a paper feed mechanism 48, the image forming unit 12, the transfer portion 30, the fixing portion 100, a cooling portion 90, a paper discharge mechanism 56, and a discharge portion 52. The image forming apparatus 10 also includes a control device 110 that outputs control information based on, for example, the image information that is inputted into the apparatus or the result of detection with sensors and controls the operation of components. The control device 110 is an example of a controller.

The container unit 50 has a function of containing the sheet material P. As illustrated in FIG. 5, the image forming apparatus 10 includes the container unit 50. The sheet material P is fed from the container unit 50. An example of the sheet material P is sheet paper (so-called cut paper) that has a predetermined size. The present disclosure is not limited by this configuration. For example, the image forming apparatus 10 may include multiple container units 50. In this case, the sheet material P is fed from a selected one of the container units 50.

The paper feed mechanism 48 has a function of transporting the sheet material P that is contained in the container unit 50 to a chain gripper 66 described later. Specifically, as illustrated in FIG. 5, the paper feed mechanism 48 includes a feed roller 62 and transport rollers 64 that transport the sheet material P along a paper feed path 40 along which the sheet material P is transported.

As illustrated in FIG. 5, the feed roller 62 feeds the sheet material P that is contained in the container unit 50 to the paper feed path 40. The transport rollers 64 transport the sheet material P that is fed to the paper feed path 40 by using the feed roller 62 to the chain gripper 66.

Figure 2:
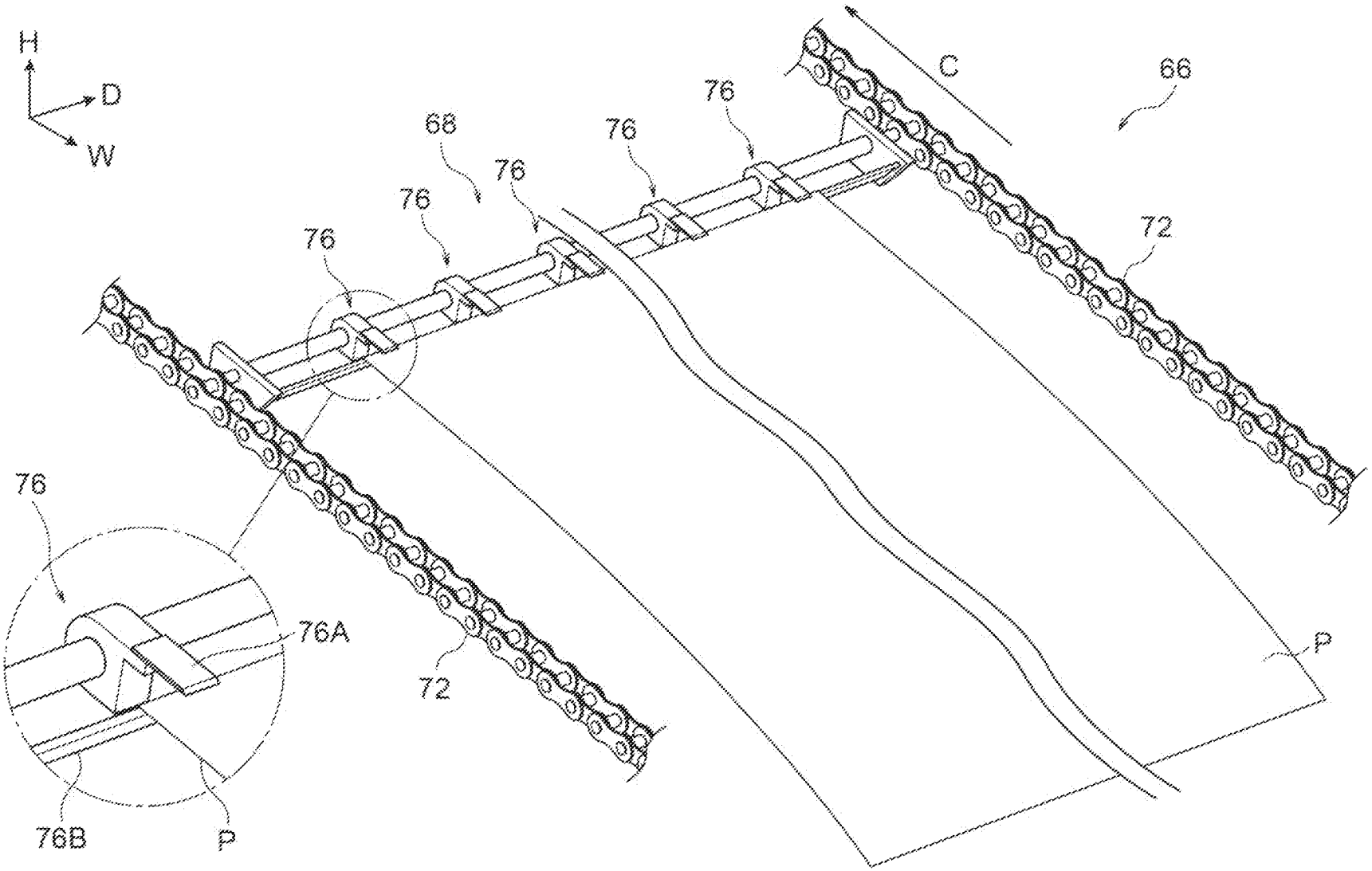
FIG. 2 is a perspective view of a chain gripper according to the exemplary embodiment in FIG. 1.

The chain gripper 66 has a function of transporting the sheet material P that is transported from the paper feed mechanism 48 to a paper feed path 42 via the transfer portion 30 and the fixing portion 100. Specifically, as illustrated in FIG. 2, the chain gripper 66 transports the sheet material P with the chain gripper 66 holding a leading edge portion (that is, a downstream edge portion of the sheet material P in the direction of transportation) of the sheet material P and transports the sheet material P to the paper feed path 42 via the transfer portion 30 and the fixing portion 100. The sheet material P that is transported to the paper feed path 42 is transported to the discharge portion 52 outside an apparatus body by using transport rollers 54 that are included in the paper discharge mechanism 56. The chain gripper 66 is an example of a transport unit. As illustrated in FIG. 1, the chain gripper 66 includes two chains 72, two sprockets 71, two sprockets 73, two sprockets 92, two sprockets 94, and two sprockets 96, and grip units 68 (see FIG. 2) that include grippers 76 that grip an end of the sheet material P.

Figure 3:
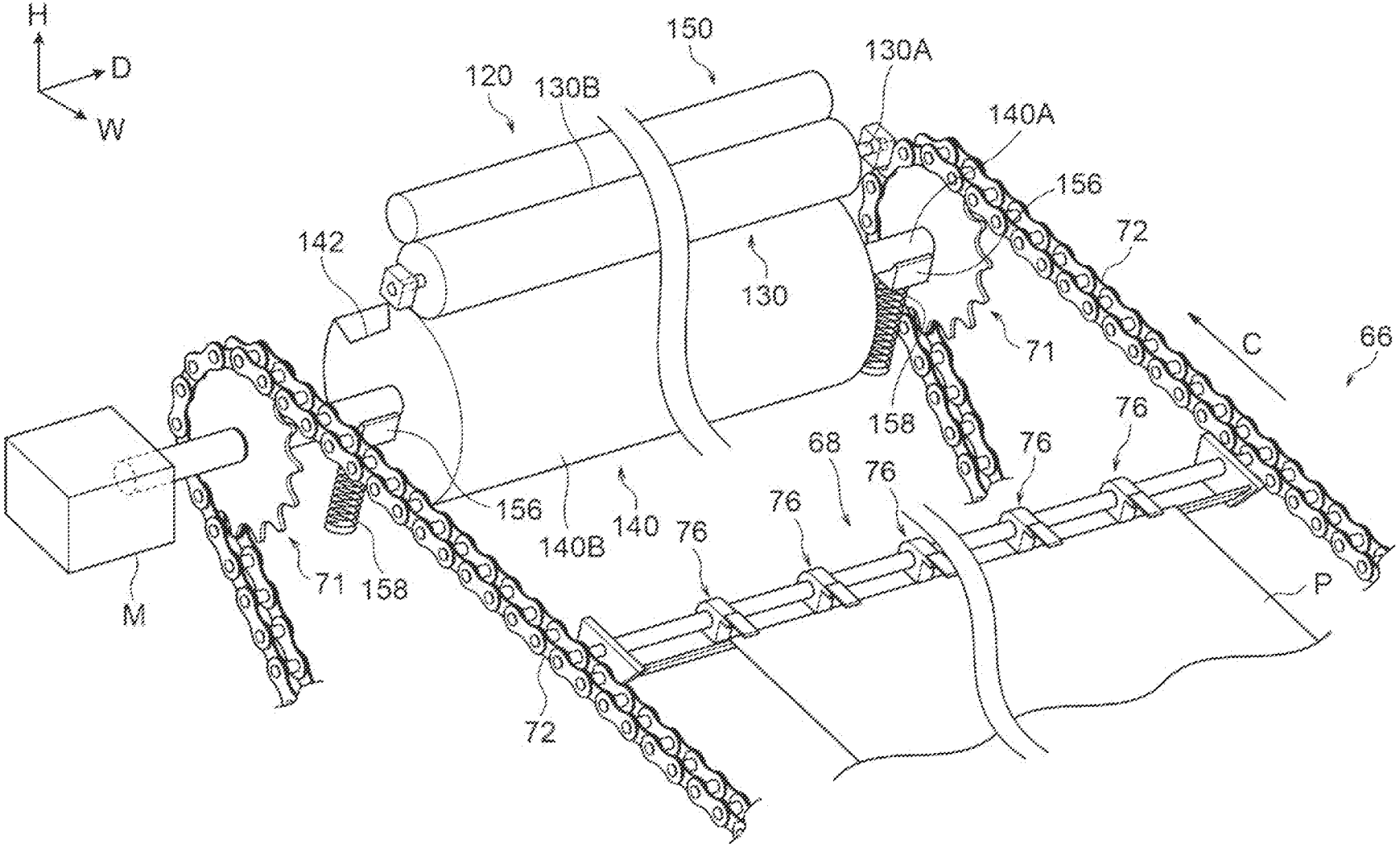
FIG. 3 is a perspective view of a fixing device according to the exemplary embodiment in FIG. 1.
Figure 4:
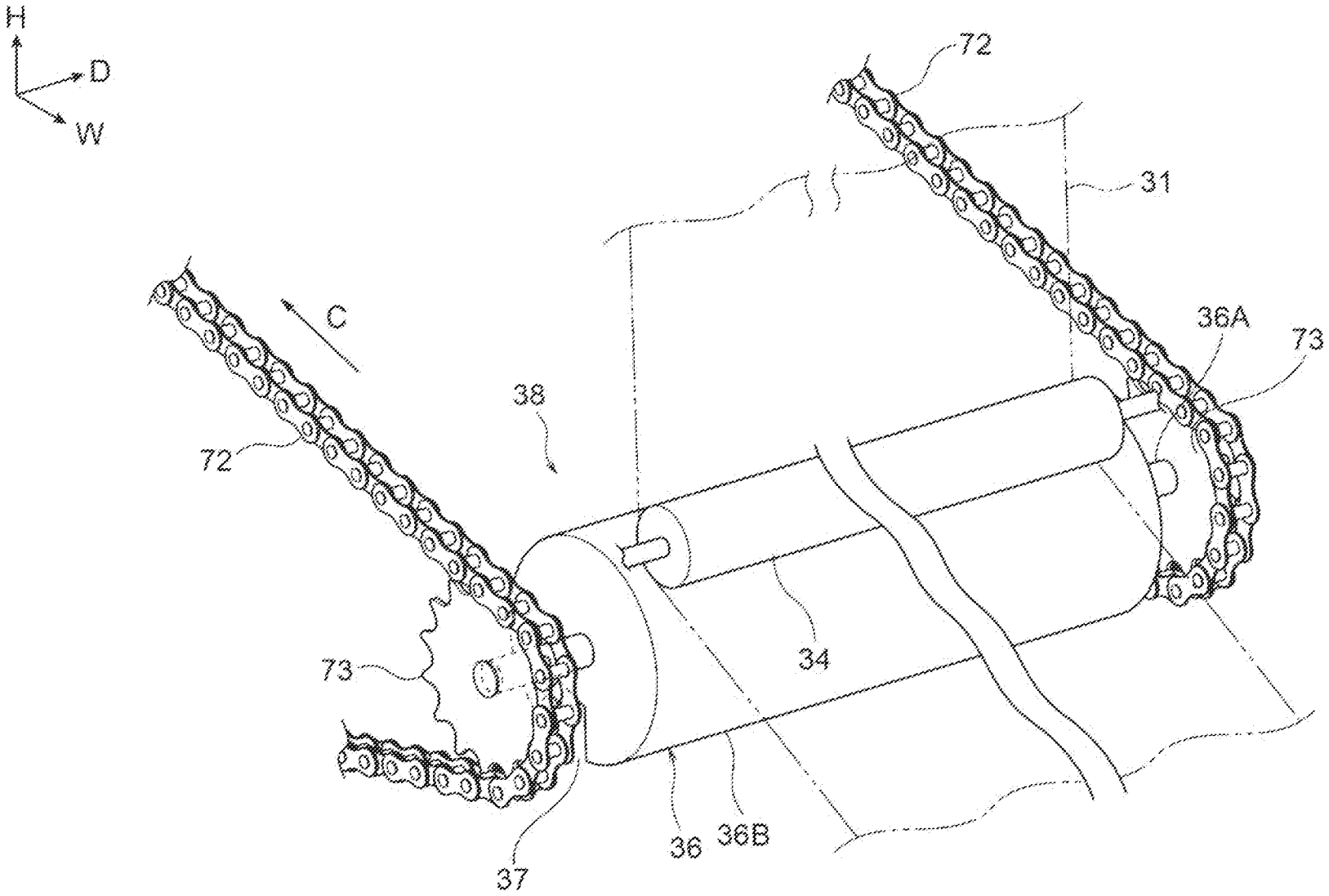
FIG. 4 is a perspective view of a facing roller and a second transfer roller according to the exemplary embodiment in FIG. 1.

As illustrated in FIG. 2, the two chains 72 are arranged at an interval in the depth direction of the apparatus. As illustrated n FIG. 1, the two chains 72 have no ends. The two chains 72 are wound around the respective sprockets 71, the respective sprockets 73, the respective sprockets 92, the respective sprockets 94, and the respective sprockets 96 that are arranged at intervals in the depth direction of the apparatus. FIG. 3 illustrates the two sprockets 71 that are arranged at an interval in the depth direction of the apparatus. FIG. 4 illustrates the two sprocket 73 that are arranged at an interval in the depth direction of the apparatus. Any one of the sprockets 71, 73, 92, 94, and 96 rotates, and consequently, the chains 72 turn in the direction of an arrow C (see FIG. 1). In some figures, teeth that are formed on the outer circumferences of the sprockets 71, 73, 92, 94, and 96 are omitted.

As illustrated in FIG. 2, each grip unit 68 that includes the grippers 76 extends between the two chains 72 in the depth direction of the apparatus. The grip unit 68 is fixed to the two chains 72 at a predetermined interval in the circumferential direction (a turning direction C) of the chains 72.

As illustrated in FIG. 2, the grippers 76 are mounted on the grip unit 68 at a predetermined interval in the depth direction of the apparatus. The grippers 76 have a function of holding (gripping) the leading edge portion of the sheet material P. Each gripper 76 is an example of a hold member. Specifically, as illustrated in FIG. 2, each gripper 76 includes a pawl 76A and a pawl base 76B. The grippers 76 are configurated so as to hold the sheet material P by interposing the leading edge portion of the sheet material P between the pawl 76A and the pawl base 76B. As for the grippers 76, for example, the pawl 76A is pressed against the pawl base 76B by using, for example, a spring, and the pawl 76A opens or closes with respect to the pawl base 76B by using, for example, a cam action. According to the present exemplary embodiment, the grippers 76 that are disposed downstream of the sheet material P in the direction of transportation thus hold the leading edge portion of the sheet material P from a position downstream of the sheet material P in the direction of transportation.

As illustrated in FIG. 2, the chain gripper 66 transports the sheet material P with a surface of the sheet material P facing upward in a manner in which the chains 72 turn in the direction of the arrow C with the grippers 76 holding the leading edge portion of the sheet material P. At this time, the chain gripper 66 transports the sheet material P in a state in which a trailing edge portion of the sheet material P is not held. That is, the sheet material P is transported while the trailing edge portion is not restricted but is free. The sheet material P passes through the transfer portion 30 and the fixing portion 100 with the surface thus facing upward.

Image Forming Unit 12

The image forming unit 12 has a function of forming the image that is to be transferred to the sheet material P in an ink-jet method. As illustrated in FIG. 5, the image forming unit 12 is disposed opposite the paper feed mechanism 48 in the vertical direction of the apparatus (the upward direction in the figure). The image forming unit 12 includes print heads 20 that form ink images and the transfer portion 30.

The print heads 20 are provided to form the ink images in respective colors. According to the present exemplary embodiment, the print heads 20 are provided for four colors of yellow (Y), magenta (M), cyan (C), and black (K). FIG. 1 and FIG. 5 illustrate (Y), (M), (C), and (K) that represent components associated with the colors described above.

The print heads 20Y, 20M, 20C, and 20K basically have the same configuration except for ink that is used. As illustrated in FIG. 1, the print heads 20Y, 20M, 20C, and 20K are arranged downstream of a particle supply device 18 in the turning direction of a transfer belt 31 along a horizontal portion of the transfer belt 31.

The print heads 20Y, 20M, 20C, and 20K discharge ink droplets in the respective colors of Y, M, C, and K such that the ink droplets are superposed on the transfer belt 31 that has an ink receptive particle layer 16A, based on the image information that is inputted into the image forming apparatus 10. The ink droplets that are discharged from the print heads 20Y, 20M, 20C, and 20K are received by the ink receptive particle layer 16A and form the ink images. That is, the image forming unit 12 forms the images on the transfer belt 31.

Transfer Portion 30

The transfer portion 30 has a function of transferring the images (the ink images) that are formed on the transfer belt 31 to the sheet material P. As illustrated in FIG. 1, the transfer portion 30 includes the transfer belt 31 that serves as an intermediate transfer body, rollers 32, a transfer roller 34, and a facing roller 36. The transfer portion 30 includes an adhesive layer formation device 24, the particle supply device 18, a cleaner 28, and a contact-separation mechanism 38.

As illustrated in FIG. 1, the transfer belt 31 has no ends, is wound around the rollers 32 and the transfer roller 34, and is stretched so as to have an inverted triangle shape in a front view (when viewed from the front in the depth direction of the apparatus). At least one of the rollers 32 is driven to rotate, and consequently, the transfer belt 31 turns in the direction of an arrow B. The print heads 20 for the respective colors, the particle supply device 18, the adhesive layer formation device 24, and the cleaner 28 are disposed along an outer circumferential portion of the transfer belt 31. A posture sensor (not illustrated) that detects the state of the posture of the transfer belt 31 and that transmits the result of detection to the control device 110 is disposed on the transfer belt 31.

The transfer roller 34 is disposed inside the transfer belt 31. The transfer roller 34 is supported such that the transfer belt 31 is pressed against the facing roller 36 (this will be described in detail later) in a manner in which the contact-separation mechanism 38 presses one of tilt portions (a left-hand tilt portion in the figure) of the transfer belt 31 that are separated in the width direction of the apparatus. The transfer roller 34 is an example of a press member. The press member may have a single body or may be integrated with a peripheral member. The facing roller 36 is an example of a transfer drum.

The facing roller 36 is disposed opposite the transfer roller 34 with the transfer belt 31 interposed therebetween. As illustrated in FIG. 4, the facing roller 36 extends in the depth direction of the apparatus.

The facing roller 36 includes shafts 36A that extend in the depth direction of the apparatus and a roller portion 36B that is disposed on the outer circumferences of the shafts 36A and that is cylindrical. The sprockets 73 described above are mounted on a pair of the shafts 36A.

The facing roller 36 is operated in conjunction with turning of the chains 72 of the chain gripper 66 by using the sprocket 73 and rotates in the turning direction C of the chains 72.

The roller portion 36B of the facing roller 36 has a recessed portion 37 in which the grippers 76 are containable. The recessed portion 37 has a groove shape that extends from an end of the roller portion 36B to the other end in the depth direction of the apparatus.

The facing roller 36 contains a heat source not illustrated and is configurated so as to be capable of heating an outer circumferential portion.

The facing roller 36 forms a nip region NT between the facing roller 36 and the transfer roller 34 that presses the transfer belt 31 against the facing roller 36. In other words, the nip region NT is formed between the facing roller 36 and the transfer belt 31. The facing roller 36 that is operated in conjunction with turning of the chains 72 and that rotates accompanies the transfer belt 31 at the nip region NT. The facing roller 36 transfers the ink images that are formed on the transfer belt 31 to the sheet material P while accompanying the transfer belt 31 with the heated outer circumferential portion of the facing roller 36 and the transfer belt 31 interposing the sheet material P that is transported by the chain gripper 66 at the nip region NT.

As illustrated in FIG. 1, the adhesive layer formation device 24 is disposed at an end (the left-side end in the figure) of the horizontal portion of the transfer belt 31 that has the inverted triangle shape in the width direction of the apparatus. The adhesive layer formation device 24 contains an adhesive and forms an adhesive layer not illustrated by applying the adhesive to the outer circumferential surface of the transfer belt 31 that turns. Examples of the adhesive include glue and organic solvent.

The particle supply device 18 is disposed downstream of the adhesive layer formation device 24 in the turning direction of the transfer belt 31 at the horizontal portion of the transfer belt 31. The particle supply device 18 Contains ink receptive particles 16 that are capable of receiving the ink droplets and supplies the ink receptive particles 16 to the transfer belt 31 that has the adhesive layer. Consequently, the ink receptive particles 16 that are supplied to the transfer belt 31 by using the particle supply device 18 adhere to the adhesive layer due to the adhesive force of the adhesive layer, and the ink receptive particle layer 16A is formed on the transfer belt 31.

The ink receptive particle layer 16A that is formed on the transfer belt 31 comes into contact with the sheet material P that is interposed between the transfer belt 31 and the facing roller 36 at the nip region NT, is heated by the facing roller 36, and is transferred to the sheet material P. At this time, if the ink receptive particle layer 16A receives the ink droplets, and consequently, the ink images are formed on the ink receptive particle layer 16A, the ink images are transferred to the sheet material P together with the ink receptive particle layer 16A.

The cleaner 28 is disposed downstream of the nip region NT in the turning direction of the transfer belt 31 and upstream of the adhesive layer formation device 24 in the turning direction. The cleaner 28 includes a blade 28*a* that is in contact with the outer circumferential surface of the transfer belt 31. The cleaner 28 is configurated so as to remove the adhesive layer that remains on the transfer belt 31 that passes through the nip region NT in conjunction with turning of the transfer belt 31, the ink receptive particles 16, and other foreign substances (such as paper dust in the case where the sheet material P is paper) by using the blade 28*a*.

Fixing Portion 100

The fixing portion 100 has a function of fixing the ink images that are transferred to the sheet material P by using the transfer portion 30 to the sheet material P.

As illustrated in FIG. 1, the fixing portion 100 includes a pre-heat unit 102 that preheating the sheet material P that is transported by the chain gripper 66, a heat unit 120 that heats the sheet material P, and a blower unit 168 that blows air to the sheet material P. The fixing portion 100 also includes the chain gripper 66 and the control device 110 described above.

As illustrated in FIG. 1, the pre-heat unit 102 is disposed downstream of the nip region NT so as to face the upper surface of the sheet material P that is transported in the direction (appropriately referred to below as a "sheet transportation direction") in which the sheet material P is transported. The pre-heat unit 102 includes a reflection member, infrared heaters (appropriately referred to below as "heaters"), and a wire net. With this configuration, the pre-heat unit 102 heats the sheet material P that is transported by the chains 72 that turn in the thickness direction of the sheet material P in a non-contact manner.

As illustrated in FIG. 1, the blower unit 168 is disposed so as to face the pre-heat unit 102 in the thickness direction of the sheet material P that is transported. The sheet material P that is transported passes between the blower unit 168 and the pre-heat unit 102. The blower unit 168 includes fans 169 that are arranged in the width direction of the sheet material P that is transported and in the sheet transportation direction. With this configuration, the fans 169 blow air to the sheet material P that is transported, and consequently, the posture of the sheet material P that is transported becomes stable.

As illustrated in FIG. 1, the heat unit 120 is disposed downstream of the pre-heat unit 102 in the sheet transportation direction. As illustrated in FIG. 3, the heat unit 120 includes a heat roller 130 that comes into contact with the sheet material P that is transported and that heats the sheet material P and a pressure roller 140 that interposes the sheet material P between the pressure roller 140 and the heat roller 130 and presses the sheet material P against the heat roller 130. The heat roller 130 is an example of a heat unit. The pressure roller 140 is an example of a rotating body.

Pressure Roller 140

The pressure roller 140 has a function of pressing the sheet material P with the sheet material P interposed between the pressure roller 140 and the heat roller 130. Specifically, as illustrated in FIG. 3, the pressure roller 140 includes a shaft 140A that extends in the depth direction of the apparatus, a roller portion 140B that is disposed on the outer circumference of the shaft 140A and that is cylindrical, and a recessed portion 142 that is formed on the outer surface of the roller portion 140B. The sprockets 71 described above are mounted on respective portions of the shaft 140A near the ends.

The pressure roller 140 is operated in conjunction with turning of the chains 72 of the chain gripper 66 by using the sprocket 71 and rotates in the turning direction C of the chains 72.

As illustrated in FIG. 3, the recessed portion 142 is a recessed portion in which the grippers 76 of each grip unit 68 are containable and has a groove shape that extends from an end of the roller portion 140B to the other end in the depth direction of the apparatus. The recessed portion 142 opens outward in the radial direction of the pressure roller 140.

Heat Roller 130

The heat roller 130 has a function of heating the sheet material P. Specifically, as illustrated in FIG. 3, the heat roller 130 has a shaft 130A and a roller portion 130B that is formed on the outer circumference of the shaft 130A.

The outer circumferential surface (an example of an outer surface) of the roller portion 130B is in contact with the outer circumferential surface (an example of the outer surface) of the roller portion 140B of the pressure roller 140, and the heat roller 130 forms a nip region NR (an example of an interposition region) at which the sheet material P is interposed between the heat roller 130 and the pressure roller 140.

The heat unit 120 also includes a heat source roller 150. The heat source roller 150 has a function of heating the heat roller 130. Specifically, the heat source roller 150 is in contact with the heat roller 130 and heats the heat roller 130.

The heat unit 120 includes support members 156 that are in contact with the respective ends of the pressure roller 140 in the axial direction of the shaft 140A and that support the pressure roller 140. The heat unit 120 also includes urging members 158 that urge the pressure roller 140 with the support members 156 interposed therebetween toward the heat roller 130. The sprockets 71 described above are mounted on the respective end portions of the shaft 140A in the axial direction.

Figure 6:
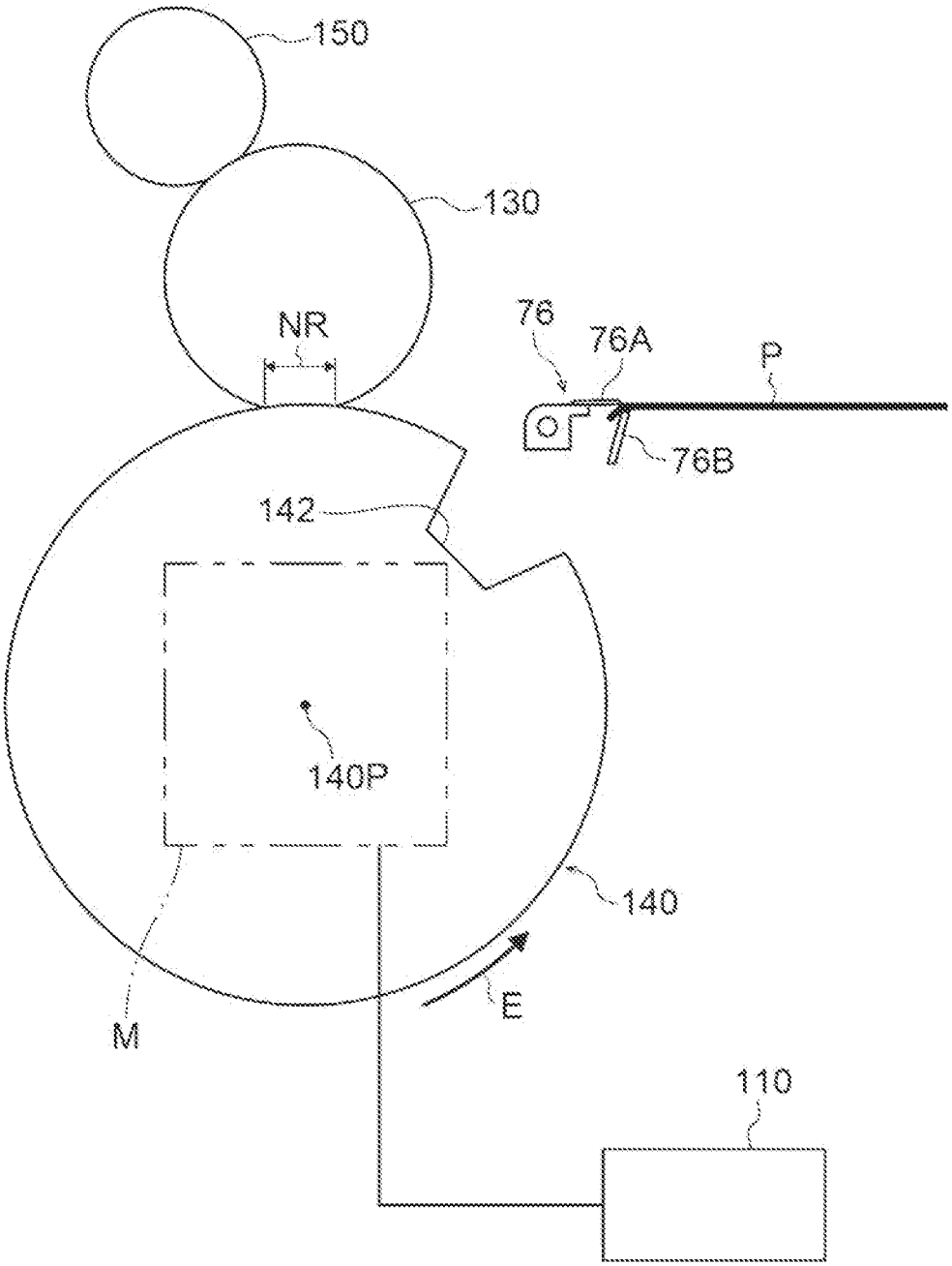
FIG. 6 is a front view schematically illustrating the relationship between the position of a heat roller and the position of a pressure roller according to the exemplary embodiment in FIG. 1.

According to the present exemplary embodiment, as illustrated in FIG. 6, the pressure roller 140 is driven by an electric motor M and rotates (rotates in the direction of an arrow E in FIG. 6), and the heat roller 130 and the heat source roller 150 are configurated so as to be operated in conjunction with rotation of the pressure roller 140. The rotational force of the pressure roller 140 is transmitted to the sprockets 71 that are mounted on the shaft 140A, causes the chains 72 of the chain gripper 66 to turn, is transmitted to the sprockets 73 that are mounted on the facing roller 36, and causes the facing roller 36 to rotate. That is, the pressure roller 140 causes the facing roller 36 to rotate in conjunction with rotation of the pressure roller 140.

With the configuration according to the present exemplary embodiment, the pressure roller 140 is driven, and the heat roller 130 and the heat source roller 150 are operated in conjunction with the pressure roller 140. The present disclosure, however, is not limited by this configuration. For example, the configuration may be such that the electric motor M is connected to the heat roller 130, the heat roller 130 is driven, and the pressure roller 140 and the heat source roller 150 are operated in conjunction with the heat roller 130. In this case, the rotational force of the pressure roller 140 that is operated in conjunction with the heat roller 130 causes the chains 72 of the chain gripper 66 to turn.

Figure 7:
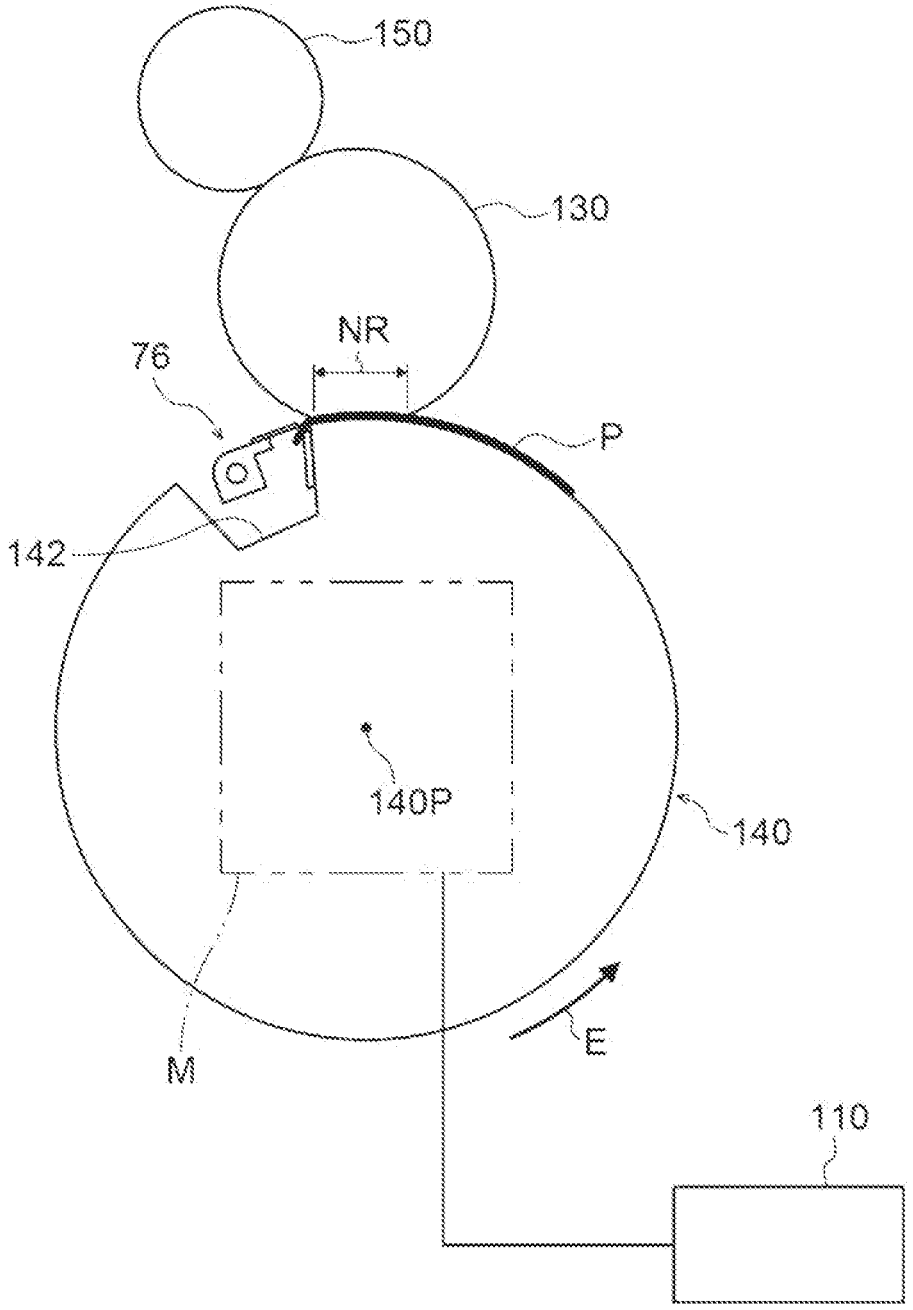
FIG. 7 is a front view schematically illustrating the relationship between the position of the heat roller and the position of the pressure roller according to the exemplary embodiment in FIG. 1.

As for the heat unit 120, as illustrated in FIG. 7, the sheet material P is interposed between the heat roller 130 and the pressure roller 140, the sheet material P is heated and pressed, and consequently, the ink images that are formed on the sheet material P are fixed to the sheet material P.

Control Device 110

The control device 110 has a function of outputting the control information, based on, for example, the image information that is inputted into the image forming apparatus 10 or the result of detection with sensors and controlling the operation of the components of the image forming apparatus 10, as described above. The control device 110 controls rotation of the electric motor M. In other words, the control device 110 controls rotation of the electric motor M and consequently controls rotation of the pressure roller 140. Rotation of the pressure roller 140 is controlled, and consequently, the turning operation of the chain gripper 66 is controlled. Examples of control of the electric motor M by using the control device 110 described herein include control of the rotational speed of the electric motor M, control of the rotational position of the electric motor M (specifically, control of the position of a motor shaft), and control of the start and stop of the electric motor.

Figure 8:
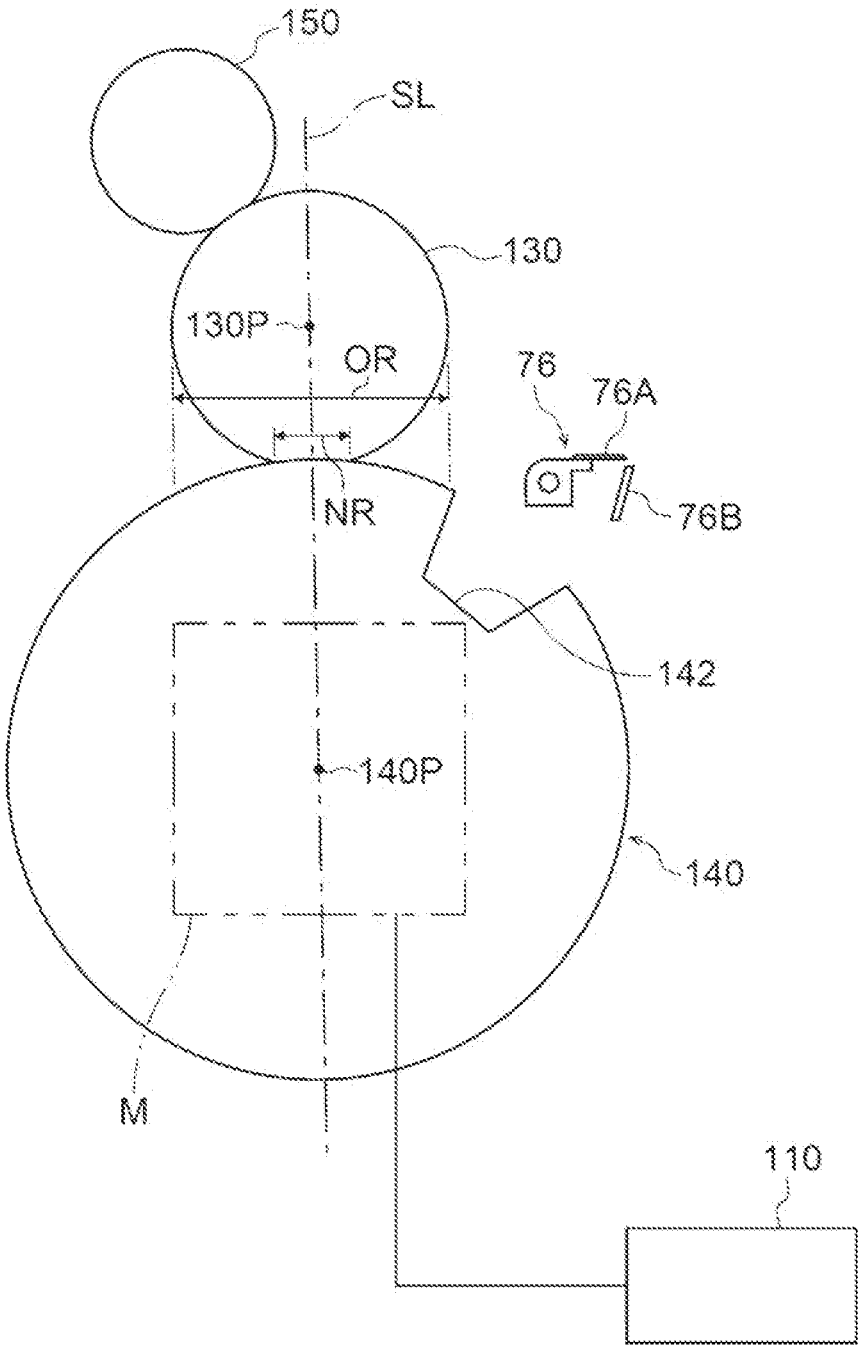
FIG. 8 is a front view schematically illustrating the relationship between the position of the heat roller and the position of the pressure roller according to the exemplary embodiment in FIG. 1.
Figure 9:
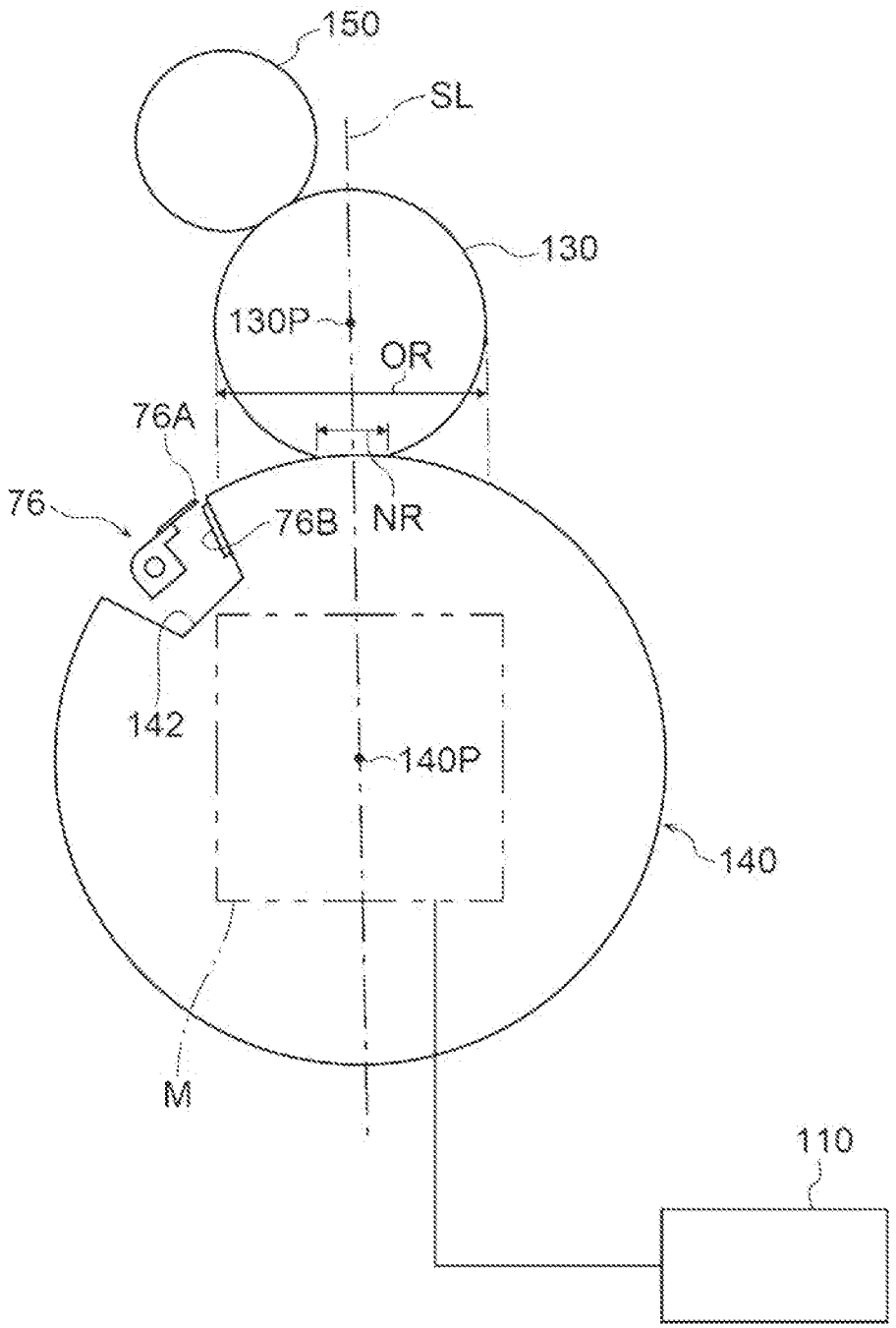
FIG. 9 is a front view schematically illustrating the relationship between the position of the heat roller and the position of the pressure roller according to the exemplary embodiment in FIG. 1.

When an anomaly is detected, the control device 110 controls rotation of the pressure roller 140 such that the recessed portion 142 stops at a position upstream of the nip region NR in the direction of rotation of the pressure roller 140. Specifically, information that represents that an anomaly such as a paper jam occurs while the sheet material P is transported is transmitted from a sensor to the control device 110, and the control device 110 operates in an anomaly detection mode. In the anomaly detection mode, the control device 110 controls the rotational position of the pressure roller 140 such that the recessed portion 142 stops at a position upstream of the nip region NR in the direction of rotation of the pressure roller 140. As for the control device 110 according to the present exemplary embodiment, rotation of the pressure roller 140 is controlled such that the recessed portion 142 stops at a position upstream of an overlap region OR in the direction of rotation, and the heat roller 130 overlaps the pressure roller 140 in the overlap region OR when viewed in the radial direction of the pressure roller 140. As illustrated in FIG. 8, the overlap region OR includes the nip region NR. The overlap region OR is a region in which the heat roller 130 overlaps the pressure roller 140 when viewed in the radial direction of the pressure roller 140. In other words, the overlap region OR is a region in which the heat roller 130 overlaps the pressure roller 140 when the pressure roller 140 and the heat roller 130 are viewed in the direction of a straight line SL that passes through the rotation axis 140P of the pressure roller 140 and the rotation axis 130P of the heat roller 130.

In the case where the grippers 76 of one of the grip units 68 holds the sheet material P when an anomaly is detected, the control device 110 causes the pressure roller 140 to stop rotating after the sheet material P is discharged to the outside via the discharge portion 52. Specifically, in the case where the grippers 76 of the grip unit 68 hold the sheet material P when an anomaly occurs, the control device 110 causes the electric motor M to drive the chain gripper 66 such that the chain gripper 66 turns, and the sheet material P is moved to the discharge portion 52 and is discharged to the outside. Subsequently, rotation of the pressure roller 140 is controlled such that the recessed portion 142 of the pressure roller 140 stops at a position upstream of the nip region NR in the direction of rotation of the pressure roller 140.

The control device 110 controls rotation of the pressure roller 140 such that the recessed portion 142 stops at a position upstream of the nip region NR in the direction of rotation of the pressure roller 140 also in the case of normal stop (for example, when a print job stops).

In the case of emergency stop, the control device 110 causes the electric motor M to stop regardless of the rotational position of the recessed portion 142.

The action according to the present exemplary embodiment will now be described.

According to the present exemplary embodiment, when an anomaly is detected, the control device 110 causes the recessed portion 142 to stop at a position upstream of the nip region NR in the direction of rotation of the pressure roller 140. That is, when an anomaly is detected, the recessed portion 142 that contains the grippers 76 of the grip unit 68 stops at a position upstream of the nip region NR in the direction of rotation of the pressure roller 140. Consequently, the distances between the grippers 76 and the heat roller 130 are longer than those in the case where the recessed portion 142 that contains the grippers 76 stops at the nip region NR when an anomaly is detected.

In particular, according to the present exemplary embodiment, when an anomaly is detected, the control device 110 causes the recessed portion 142 stops at a position upstream of the overlap region OR in the direction of rotation of the pressure roller 140. The overlap region OR is wider than the nip region NR.

According to the present exemplary embodiment, in the case where the grip unit 68 holds the sheet material P when an anomaly is detected, the control device 110 causes the chain gripper 66 to turn, and the sheet material P is discharged to the outside via the discharge portion 52. Subsequently, the control device 110 causes the pressure roller 140 to stop rotating. According to the present exemplary embodiment, in this way, the sheet material P may be inhibited from being overheated due to the heat of the heat roller 130 in the apparatus unlike the configuration in which the pressure roller 140 stops rotating before the sheet material P is discharged. In this way, the sheet material P may be inhibited from being overheated and discharged from the discharge portion 52.

According to the present exemplary embodiment, the control device 110 causes the recessed portion 142 to stop at a position upstream of the nip region NR in the direction of rotation of the pressure roller 140 also in the case of the normal stop.

According to the present exemplary embodiment, the control device 110 causes the recessed portion 142 that contains the grippers 76 to stop at a position upstream of the nip region NR in the direction of rotation of the pressure roller 140 when an anomaly is detected. That is, the recessed portion 142 that contains the grippers 76 may be inhibited from stopping at the nip region NR. In this way, an image failure may be inhibited from occurring on the ink images that are fixed (formed) to the sheet material P due to overheat of the grippers 76.

When an anomaly is detected, the control device 110 according to the exemplary embodiment described above controls rotation of the pressure roller 140 such that the recessed portion 142 stops at a position upstream of the nip region NR in the direction of rotation of the pressure roller 140. The present disclosure, however, is not limited by this configuration. For example, when an anomaly is detected, the control device 110 may control rotation of the pressure roller 140 such that the recessed portion 142 stops at a position downstream of the nip region NR in the direction of rotation of the pressure roller 140 (see FIG. 9). The control device 110 may control rotation of the pressure roller 140 such that the recessed portion 142 stops at a position downstream of the overlap region OR in the direction of rotation of the pressure roller 140. With this configuration, the same action as that according to the exemplary embodiment described above is taken.

As for the normal stop, the control device 110 may control rotation of the pressure roller 140 such that the recessed portion 142 stops at a position downstream of the nip region NR in the direction of rotation of the pressure roller 140 as in the case where an anomaly is detected.

According to the exemplary embodiment described above, in the case where the grippers 76 of the grip unit 68 hold the sheet material P when an anomaly is detected, the pressure roller 140 stops rotating after the sheet material P is discharged to the outside via the discharge portion 52. The present disclosure, however, is not limited by this configuration. For example, the pressure roller 140 may stop rotating without discharging the sheet material P to the outside via the discharge portion 52. In this case, the control device 110 may cause the recessed portion 142 to stop at a position upstream of the nip region NR in the direction of rotation of the pressure roller 140 such that the sheet material P does not stop at the nip region NR. With this configuration, thermal degradation of the sheet material P due to the heat of the heat roller 130 may be inhibited from occurring unlike the case where the sheet material P stops at the nip region NR.

Figure 10:
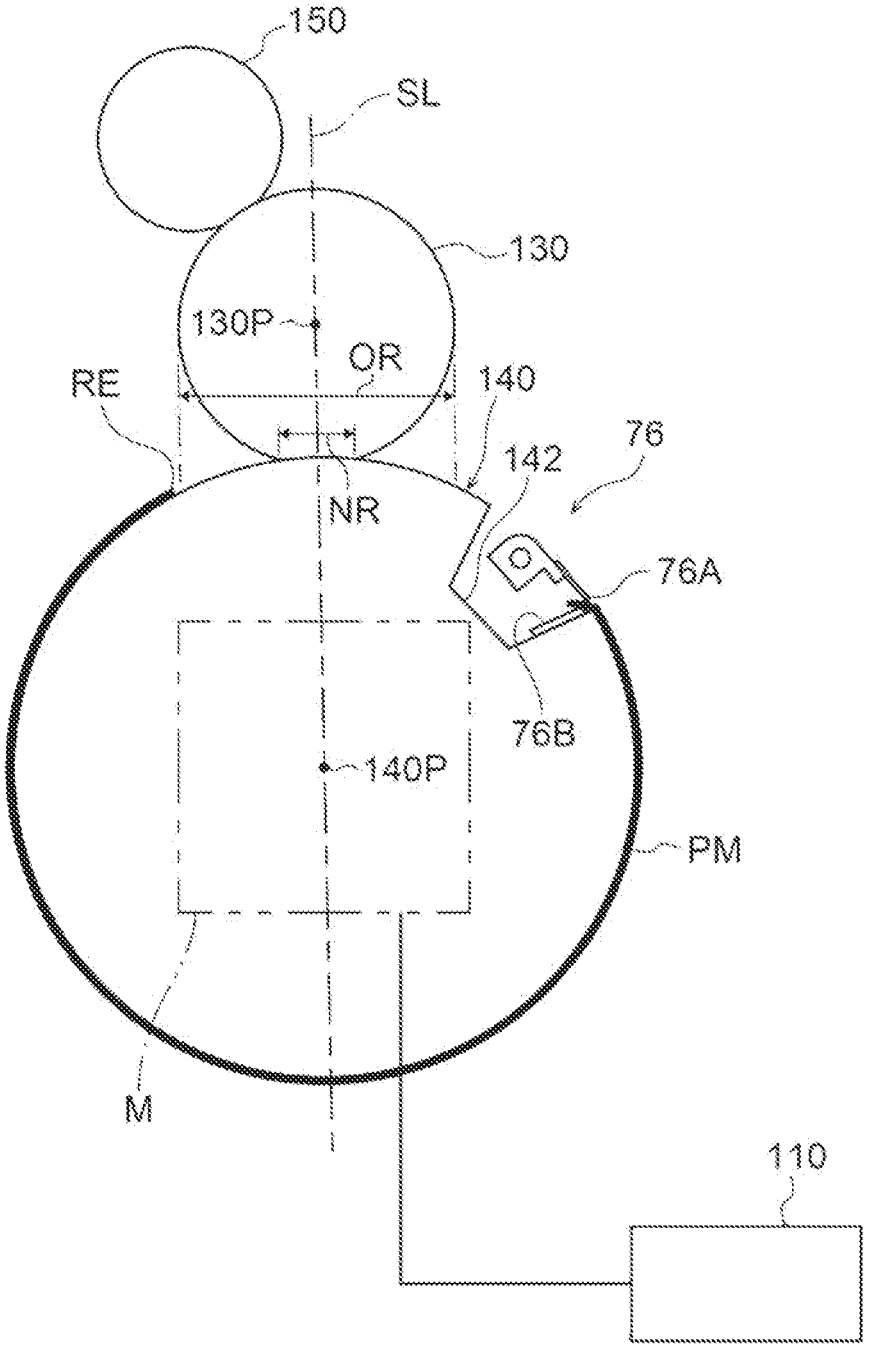
FIG. 10 is a front view schematically illustrating the relationship between the position of the heat roller and the position of the pressure roller according to the exemplary embodiment in FIG. 1.

When an anomaly is detected, the control device 110 according to the exemplary embodiment described above causes the recessed portion 142 that contains the grippers 76 to stop at a position upstream of the nip region NR in the direction of rotation of the pressure roller 140. The present disclosure, however, is not limited by this configuration. When an anomaly is detected, the same action as that according to the exemplary embodiment described above is taken provided that the control device 110 controls rotation of the pressure roller 140 such that the recessed portion 142 stops at a position away from the nip region NR in the direction of rotation of the pressure roller 140. For this reason, as illustrated in FIG. 10, when it is assumed that the grippers 76 grip the sheet material P that has the predetermined maximum size (appropriately referred to below as a "sheet material PM"), the control device 110 may control rotation of the pressure roller 140 such that a trailing edge RE of the sheet material PM stops at a position downstream of the nip region NR in the direction of rotation of the pressure roller 140. With this configuration, even in the case where the recessed portion 142 that contains the grippers 76 stops at a position away from the nip region NR in the direction of rotation of the pressure roller 140 when an anomaly is detected, the trailing edge RE of the sheet material PM is positioned downstream of the nip region NR in the direction of rotation of the pressure roller 140. In this way, the images may be inhibited from being degraded due to a difference in how the images on the sheet material PM melts even when the pressure roller is partly overheated due to the heat of the heat roller (radiant heat) when stopping unlike the configuration in which the trailing edge RE of the sheet material PM does not stop at a position downstream of the nip region NR in the direction of rotation.

Figure 11:
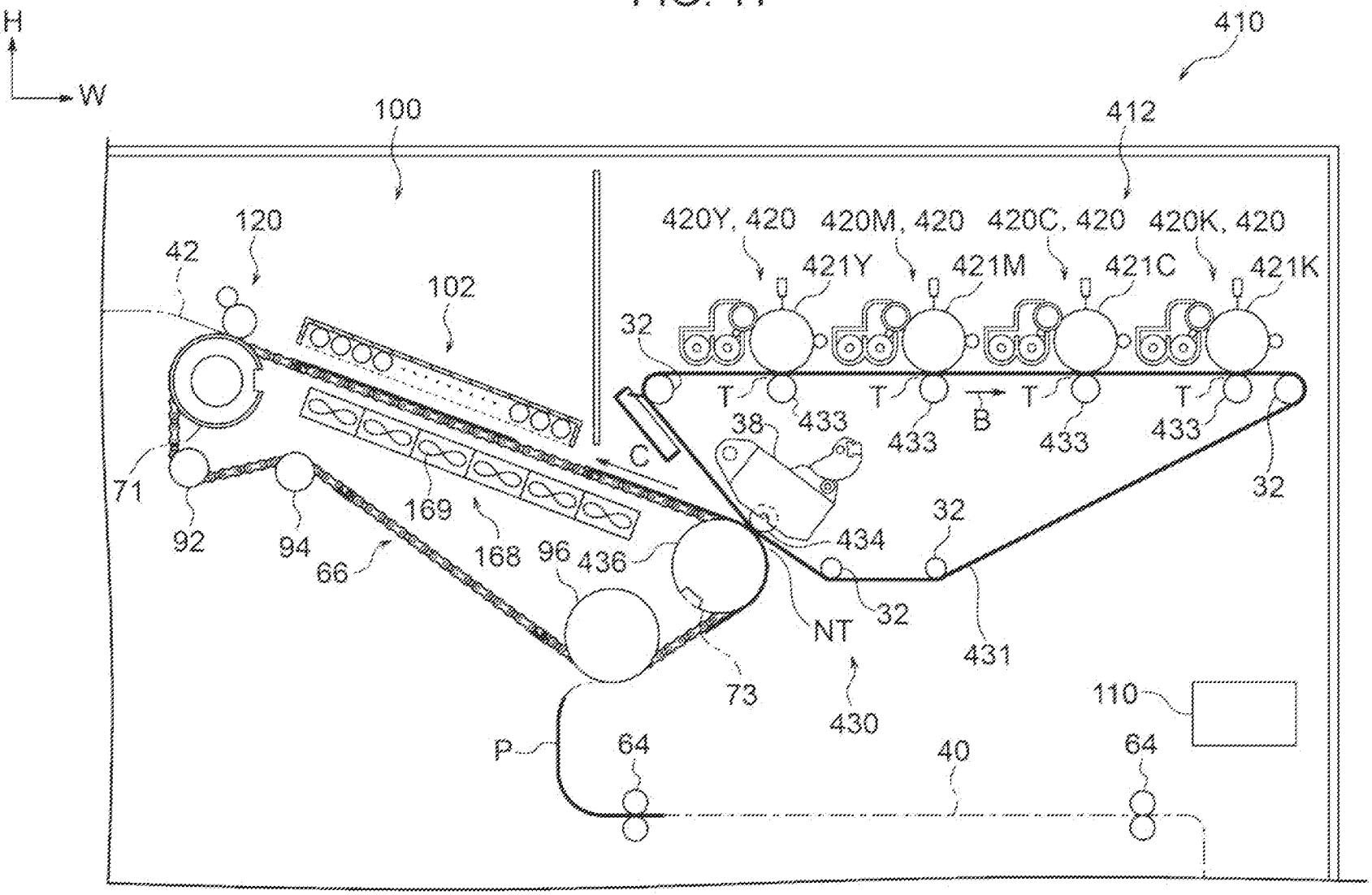
FIG. 11 schematically illustrates a front view of a part of an electrophotographic image forming apparatus according to another exemplary embodiment.

The action that is taken according to the exemplary embodiment described above is not limited to the action of an ink-jet image forming apparatus but is taken for an electrophotographic image forming apparatus that forms an image by using toner in the same manner. An image forming apparatus 410 that is an example of an electrophotographic image forming apparatus according to an exemplary embodiment of the present disclosure will now be described. As illustrated in FIG. 11, the image forming apparatus 410 includes an image forming unit 412 and a transfer portion 430 instead of the image forming unit 12 and the transfer portion 30 of the image forming apparatus 10. The transfer portion 430 includes a transfer belt 431, a second transfer roller 434, and a facing roller 436 instead of the transfer belt 31, the transfer roller 34, and the facing roller 36. The transfer portion 430 includes first transfer rollers 433 for respective colors of an image, and the transfer belt 431 is wound outside the first transfer rollers 433. The image forming unit 412 includes toner image forming units 420Y, 420M, 4200, and 420K that form toner images instead of the print heads 20 of the image forming apparatus 10. The toner image forming units 420 for the respective colors include photoconductor drums 421 for the respective colors opposite the first transfer rollers 433 with the transfer belt 431 interposed therebetween. The toner image forming units 420 form the toner images on the photoconductor drums 421 for the respective colors and transfer the toner images to the transfer belt 431 at first transfer positions T between the photoconductor drums 421 and the first transfer rollers 433. The toner images that are transferred to the transfer belt. 431 are transferred to the sheet material P at the nip region NT that is formed between the second transfer roller 434 and the facing roller 436. Except for the matters described above, the electrophotographic image forming apparatus 410 has the same configuration as that of the ink-jet image forming apparatus 10.

According to the exemplary embodiment described above, the grippers 76 hold the leading edge portion of the sheet material P but are not limited by this configuration. For example, the grippers 76 may be configurated so as to hold portions that extend from the side edges of the sheet material P toward a portion of the sheet material P near the leading edge. The portion of the sheet material P near the leading edge is a portion (a front portion) downstream of the center of the sheet material P in the direction of transportation.

According to the exemplary embodiment described above, the fixing device that has the function of transporting the sheet material P and the function of fixing the images to the sheet material P is used as an example of a transport device but is not limited by this configuration. Examples of the transport device may include a device that has only the function of transporting and a device that has another function other than the function of fixing and the function of transporting.

The present disclosure is not limited to the exemplary embodiment described above but may be modified, altered, and improved in various ways without departing from the spirit thereof. For example, the modifications described above may be configurated by appropriately combining some of these.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A recording medium transport device for an image forming apparatus comprising:

a rotating body that has a recessed portion on an outer surface;

a heat unit that is in contact with the outer surface of the rotating body, that rotates, and that forms an interposition region in which the recording medium is interposed between the heat unit and the rotating body;

a transport unit that includes a hold member capable of holding a portion of the recording medium near a leading edge, that transports the recording medium by moving the hold member in a direction of rotation of the rotating body with the hold member contained in the recessed portion, and that causes the hold member to pass through the interposition region; and a controller that controls rotation of the rotating body such that the recessed portion stops at a position upstream or downstream of the interposition region in the direction of rotation of the rotating body when an anomaly is detected.

2. The recording medium transport device according to claim 1, wherein the controller controls rotation of the rotating body such that the recessed portion stops at a position upstream of an overlap region in the direction of rotation of the rotating body, and the heat unit overlaps the rotating body in the overlap region when viewed in a radial direction of the rotating body.

3. The recording medium transport device according to claim 1, wherein the controller controls rotation of the rotating body such that a trailing edge of the recording medium that has a maximum size stops at a position downstream of the interposition region in the direction of rotation of the rotating body.

4. The recording medium transport device according to claim 2, wherein the controller controls rotation of the rotating body such that a trailing edge of the recording medium that has a maximum size stops at a position downstream of the interposition region in the direction of rotation of the rotating body.

5. The recording medium transport device according to claim 1, wherein the controller causes the rotating body to stop rotating after the rotating body that rotates moves the hold member to a discharge portion for the recording medium and discharges the recording medium in a case where the hold member holds the recording medium.

6. The recording medium transport device according to claim 2, wherein the controller causes the rotating body to stop rotating after the rotating body that rotates moves the hold member to a discharge portion for the recording medium and discharges the recording medium in a case where the hold member holds the recording medium.

7. The recording medium transport device according to claim 3, wherein the controller causes the rotating body to stop rotating after the rotating body that rotates moves the hold member to a discharge portion for the recording medium and discharges the recording medium in a case where the hold member holds the recording medium.

8. The recording medium transport device according to claim 4, wherein the controller causes the rotating body to stop rotating after the rotating body that rotates moves the hold member to a discharge portion for the recording medium and discharges the recording medium in a case where the hold member holds the recording medium.

9. A fixing device that serves as the recording medium transport device according to claim 1, the fixing device comprising:

a pressure roller that serves as the rotating body; and a heat roller that serves as the heat unit.

10. A fixing device that serves as the recording medium transport device according to claim 2, the fixing device comprising:

a pressure roller that serves as the rotating body; and a heat roller that serves as the heat unit.

11. A fixing device that serves as the recording medium transport device according to claim 3, the fixing device comprising:

a pressure roller that serves as the rotating body; and a heat roller that serves as the heat unit.

12. A fixing device that serves as the recording medium transport device according to claim 4, the fixing device comprising:

a pressure roller that serves as the rotating body; and a heat roller that serves as the heat unit.

13. A fixing device that serves as the recording medium transport device according to claim 5, the fixing device comprising:

a pressure roller that serves as the rotating body; and a heat roller that serves as the heat unit.

14. A fixing device that serves as the recording medium transport device according to claim 6, the fixing device comprising:

a pressure roller that serves as the rotating body; and a heat roller that serves as the heat unit.

15. A fixing device that serves as the recording medium transport device according to claim 7, the fixing device comprising:

a pressure roller that serves as the rotating body; and a heat roller that serves as the heat unit.

16. An image forming apparatus comprising:

a transfer portion that transfers an image to a recording medium; and the fixing device according to claim 9 that fixes the image that is transferred to the recording medium to the recording medium.

17. An image forming apparatus comprising:

a transfer portion that transfers an image to a recording medium; and the fixing device according to claim 10 that fixes the image that is transferred to the recording medium to the recording medium.

18. An image forming apparatus comprising:

a transfer portion that transfers an image to a recording medium; and the fixing device according to claim 11 that fixes the image that is transferred to the recording medium to the recording medium.

19. An image forming apparatus comprising:

a transfer portion that transfers an image to a recording medium; and the fixing device according to claim 12 that fixes the image that is transferred to the recording medium to the recording medium.

20. A recording medium transport device for an image forming apparatus comprising:

a pressure roller that has a recessed portion on an outer surface;

a heating roller that is in contact with the outer surface of the pressure roller, that rotates, and that forms an interposition region in which the recording medium is interposed between the heating roller and the pressure roller;

a chain drive connected to a gripper capable of holding a portion of the recording medium near a leading edge, that transports the recording medium by moving the gripper in a direction of rotation of the pressure roller with the gripper contained in the recessed portion, and that causes the gripper to pass through the interposition region; and a controller that controls rotation of the pressure roller such that the recessed portion stops at a position upstream or downstream of the interposition region in the direction of rotation of the pressure roller when an anomaly is detected.

* * * * *